United States Patent [19]

Yoshimura

[11] Patent Number: 4,542,795

[45] Date of Patent: Sep. 24, 1985

[54] LEADER ANGLE CONTROL DEVICE

[75] Inventor: Yukio Yoshimura, Hiratsuka, Japan

[73] Assignee: Kabushiki Kaisha Komatsu Seisakusho, Tokyo, Japan

[21] Appl. No.: 481,856

[22] Filed: Apr. 4, 1983

[51] Int. Cl.[4] ..... B23B 39/06

[52] U.S. Cl. ..... 173/2; 173/39; 33/333; 33/366; 408/13

[58] Field of Search ..... 173/2, 39, 44, 20; 408/13; 33/406, 333, 366; 179/40; 364/463; 340/685; 52/115, 116

[56] References Cited

U.S. PATENT DOCUMENTS 4,022,284 5/1977 Crow ..... 173/2
4,274,494 6/1981 Bergstrom ..... 173/2
4,410,049 10/1983 Melin ..... 173/2

FOREIGN PATENT DOCUMENTS 48-17414 10/1974 Japan .
1157915 6/1969 United Kingdom ..... 173/39

*Primary Examiner*—Donald R. Schran
*Assistant Examiner*—James L. Wolfe
*Attorney, Agent, or Firm*—Spensley, Horn, Jubas & Lubitz

[57] ABSTRACT

A leader angle control device comprises two inclinometers for measuring inclination of a leader in two directions, an arithmetic unit for calculating the length of two backstays which support the leader based on the detected inclination of the leader and a control unit for controlling backstay cylinder driving oil.

In one embodiment of the leader angle control device, the leader angle is controlled manually to a certain extent before automatic control takes place, whereby the acceleration applied to the leader at the time of shift to automatic control is kept small and then gradually increases, thus enabling smooth control of the inclination of the leader.

12 Claims, 16 Drawing Figures

LEADER ANGLE CONTROL DEVICE

BACKGROUND OF THE INVENTION

1. Field of the Invention

The present invention relates to a leader angle control device for a civil foundation engineering works machine, for example, a pile driver, an earth auger, and so forth.

2. Description of the Prior Art

FIGS. 1 and 2 show a pile driver, wherein an upper body 2 of the pile driver 1 is rotatably mounted on a tractor (typically caterpillar type) 3, and a leader 5 is mounted on a bracket 4 rigidly held to the front part of the turning assembly 2, the leader 5 being supported by two backstays 6 and 7 having backstay cylinders 6*a* and 7*a* respectively. The tops of the backstays 6 and 7 are pivotally attached to the upper positions 5*a* and 5*b* of the leader 5 respectively, and the bottoms of the backstays 6 and 7 are pivotally held to points S and T in the rear side parts of the upper body. The bottom part of the leader 5 is pivotally mounted on the front end 4*a* of the bracket 4. The two back-stay cylinders 6*a* and 7*a* are designed to keep the leader 5 in the vertical position by the extend/retract control. For bringing the leader 5 in the vertical position, a person measures the inclination angle of the leader 5 from the front, rear, left or right of the leader 5 at a certain distance from the pile driver 1 using a transit or other suitable means, the measuring person then notifies the operator of the direction in which the leader 5 is to be moved for the correction of inclination by signalling, and in response to the signal the operator operates a backstay cylinder control lever by hand, thus controlling the left and right backstay cylinders 6*a* and 7*a*.

The prior art method described above has such drawbacks as that it requires a person to measure the inclination angle in addition to the pile driver operator, and the vertical setting of the leader is a difficult and time-consuming work. Another type of the leader angle control device is known in the art. This device uses nine divided areas in vertical view. Due to the area which upper portion of the leader belongs to, operation of both stay cylinders, that is, extension, retraction and stop are uniquely determined. The area to which the leader belongs is logically judged by a logical circuit to which output signals from the inclinometers are applied.

The device, however, the course which the upper portion of the leader follows to return to the vertical position is of L form. Therefore the distance of the course is long and thus time required to return to the vertical position is long. The device has the disadvantage that it is difficult to eliminate the dangerous state of the leader.

SUMMARY OF THE INVENTION

An object of the present invention is to provide a leader angle control device capable of speedy and safe leader vertical alignment.

Another object of the present invention is to provide a leader angle control unit designed to indicate the working length of the backstay cylinder to be controlled at all times.

Still another object of the present invention is to provide a leader angle control device capable of maintaining the stability of the foundation civil engineering works machines by keeping the acceleration to be applied to the leader at the control start-up small through the temporary reduction of the control system deviation at the automatic control start-up and the gaining of the true value by the gradual increase with time.

Still another object of the present invention is to provide a highly safe leader angle control device which allows the operator to know the inclination of the leader easily on the indicator and can help to enhance the work efficiency.

According to a preferred embodiment of the present invention, the leader angle control device comprises two inclinometers for measuring the leader inclinations in two different directions, an arithmetic unit for calculating the working length of each backstay cylinder to be corrected based on the detected inclination angle, and a means to control the flow of the backstay cylinder driving oil.

BRIEF DESCRIPTION OF THE DRAWINGS

A detailed description of the invention will be made with reference to the accompanying drawings, wherein same numerals designate corresponding parts in the several figures.

DESCRIPTION OF THE PREFERRED EMBODIMENT

The following description is of the best presently contemplated mode of carrying out the invention. This description is not to be taken in a limiting sense, but is made merely for the purpose of illustrating the general principles of the invention since the scope of the invention is best defined by the appended claims.

Figure 3:
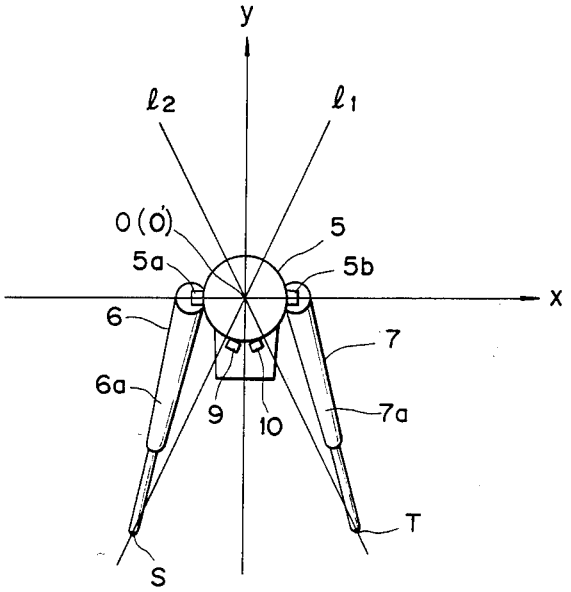
FIG. 3 is a plan view of the pile driver showing the relationship between a leader, backstays and inclinometers according to the present invention.

In FIG. 3, in the specified positions at the bottom of the leader 5, inclinometers 9 and 10 for detecting the inclination angles of the leader 5 in two directions are disposed, and these two inclinometers 9 and 10 detect leader inclination angles about line l1 and l2 extending from a fulcrum O of the leader inclining to the points S and T of the backstays 6 and 7 being held respectively.

Referring to FIG. 3, when the cylinder 6*a* is extended or retracted, the leader 5 turns about the line l2 (turning fulcrum is point O), while when the cylinder 7*a* is extended or retracted the leader 5 thus about the line l1.

Figure 4:
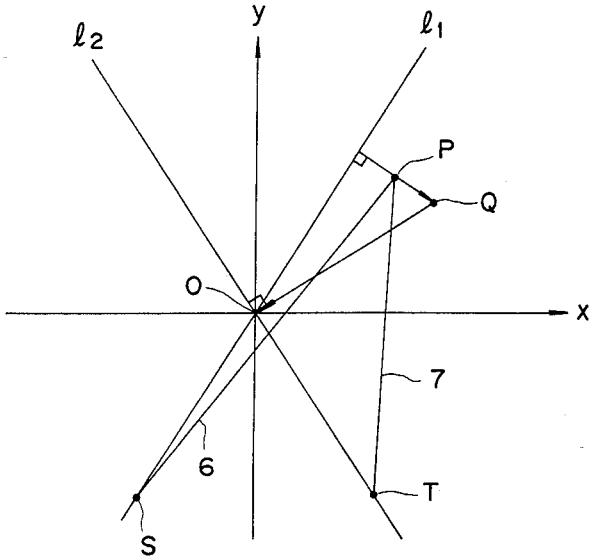
FIG. 4 and FIG. 5 are views for explaining a principle of the leader angle control device according to the present invention.

Now, if the leader 5 inclines, and the leader center O, which is in the middle of positions 5*a* and 5*b* where the backstays are mounted shifts to a point P shown in FIG. 4 departing from the vertical line of the mounting point O of the leader 5, when the cylinder 7a is caused to retract, the leader 5 would turn about the line l1 and as the center O' comes to a point Q, the cylinder 7a would be stopped. Then, cylinder 6a is caused to retract, the leader 5 would turn about the line l2 and as the center O' comes to the vertical line of the mounting point O, the cylinder 6a is stopped. In this manner, the leader 5 can be made vertical. In this case, by controlling both cylinders 7a and 7a concurrently, the center O', can be shifted onto the vertical line of the mounting point O from the point P directly. The displacements corresponding to segment $\overline{PQ}$ and $\overline{QO}$ can be obtained by calculation from the outputs of the inclinometers 9 and 10 (shown in FIG. 3). Accordingly, by supplying the oil in the amount corresponding to the displacements PQ and QO to the backstay cylinders 7a and 6a respectively, the center O' can be shifted from the position of point P to a position on the vertical line of the mounting point O directly, thus enabling the leader 5 to become vertical. In addition, by controlling the backstay cylinders 6a and 7a concurrently, the time required for making the leader 5 can be shortened.

Figure 5:
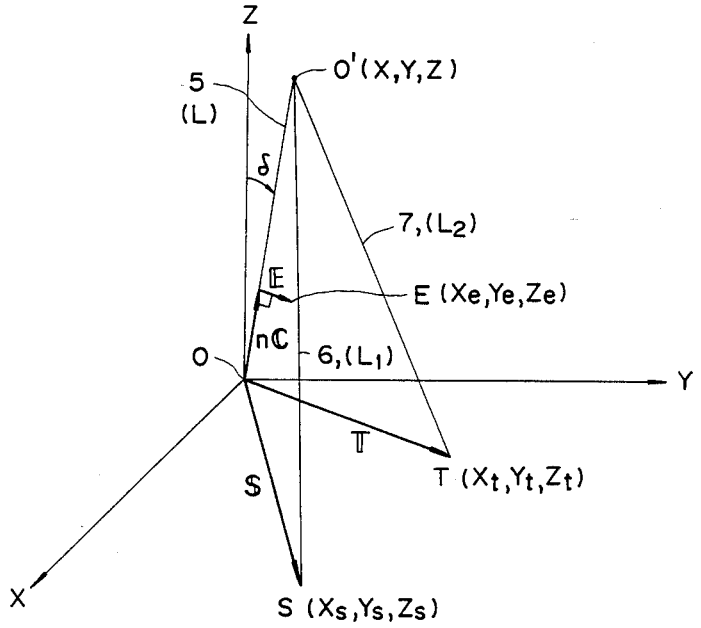

Referring now to FIG. 5, $L_1$ (=SO') and $L_2$ (=TO') are the lengths of the backstays 6 and 7, and (Xs, Ys, Zs) and (Xt, Yt, Zt) are the coordinates of the points S and T. Further, when L(=OO') is assumed to be the distance between O and O' of the leader 5, the point O' becomes the intersection of three sphericals having the centers O, S, and T and the radii L, $L_1$, and $L_2$ respectively, and the following equations are established.

$$X^2+Y^2+Z^2=L^2 \tag{1}$$

$$(X-Xs)^2+(Y-Ys)^2+(Z-Zs)^2=L_1^2 \tag{2}$$

$$(X-Xt)^2+(Y-Yt)^2+(Z-Zt)^2=L_2^2 \tag{3}$$

where X, Y, Z, $L_1$, and $L_2$ are variables, and Xs, Ys, Zs, Xt, Yt, Zt and L are constants.

When Zs=Zt=0, Xs=Xt, and Ys=−Yt, the above Eqs. (1) to (3) may be written as $$X^2+Y^2+Z^2=L^2 \tag{4}$$

$$(X-Xs)^2+(Y-Ys)^2+Z^2=L_1^2 \tag{5}$$

$$(X-Xs)^2+(Y-Ys)^2+Z^2=L_2^2 \tag{6}$$

When the leader angle δ is small, the value of Z may be taken as substantially equal to the distance L. from the above Eqs. (4) to (6), X, Y, and Z can be expressed as follows:

$$X=\frac{2(Xs^2+Ys^2)-L_1^2-L_2^2+2L^2}{4Xs} \tag{7}$$

$$Y=-\frac{L_1^2-L_2^2}{4Ys} \tag{8}$$

$$Z\approx L \tag{9}$$

In FIG. 5, direction of the inclinometer 9 (shown in FIG. 3) is represented by the unit vector . The end point coordinates of the unit vector is (Xe, Ye, Ze), and the coordinates of the point which the inclinometer 9 is disposed is (nX, nY, nZ), where 0<n<1.

Since vector is orthogonal to vector ¢ and $ respectively (where vector ¢ is 00, and vector $ is OS) the following equations are established:

$$X(Xe-nX)+Y(Ye-nY)+Z(Ze-nZ)=0 \tag{10}$$

$$Xs(Xe-nX)+Ys(Ye-nY)+Zs(Ze-nZ)=0 \tag{11}$$

On the other hand, the detected angle A by the inclinometer 9 is given by the following equation:

$$A\approx \tan A=\frac{Ze-nZ}{\sqrt{(Xe-nX)^2+(Ye-nY)^2}} \tag{12}$$

Eq. (12) can be rewritten using Eqs. (10) and (11) as follows:

From (10)x Ys−(5) x Y $$Xe-nX=-\frac{(YsZ-YZs)(Ze-nZ)}{YsX-YXs} \tag{13}$$

From (10) x Xs−(11) x X $$Ye-nY=-\frac{(XsZ-XZs)(Ze-nZ)}{ZsY-XYs} \tag{14}$$

Then, Eqs, (13) and (14) are squared, and addition thereof is made as follows:

$$(Xe-nX)^2+(Ye-nY)^2=\frac{(Ze-nZ)^2\{(YsZ-YZs)^2+(ZsZ-XZs)^2\}}{(XsY-XYs)^2} \tag{15}$$

By substituting Eq. (15) into Eq. (12), the A can be expressed as follows:

$$A\approx\frac{YXs-XYs}{\sqrt{(YZs-YsZ)^2+(XZs-XsZ)^2}} \tag{16}$$

Then substituting Eqs. (7), (8), and (9) into Eq. (16), and assuming that Zs=0, $$A=\frac{(XS^2-Ys^2)L_1^2-(Xs^2+Ys^2)L_2^2+2Ys^2(Xs^2+Ys^2+L^2)}{-4C\sqrt{Xs^2+Ys^2\cdot XsYs}} \tag{17}$$

Figure 1:
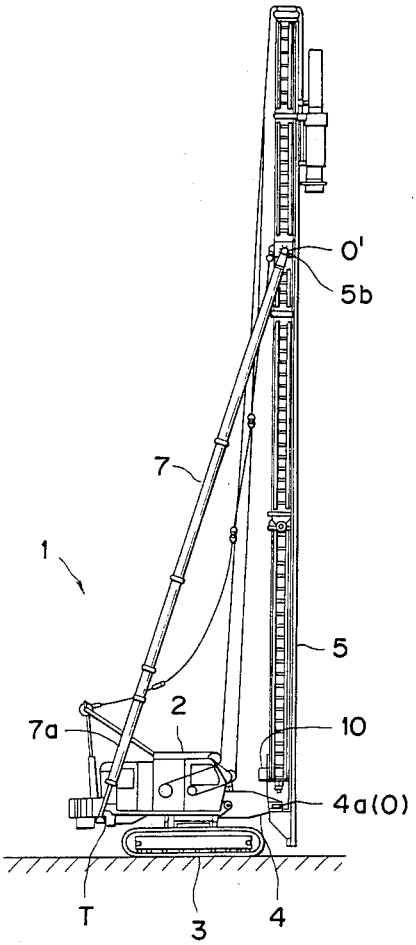
FIG. 1 is a side view of the pile driver.
Figure 2:
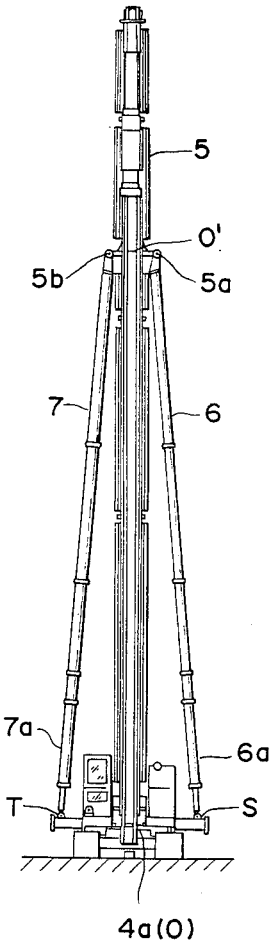
FIG. 2 is a front view of the pile driver.

Now, when the lengths of the backstays 6 and 7 are $L_{10}$ and $L_{20}$ when the leader 5 is vertical and working lengths of backstay cylinders 6a and 7a for setting the leader 5 vertical are $\Delta L_1$ and $\Delta L_2$, the length of the backstays $L_1$, $L_2$ are generally expressed as $$L_1=L_{10}+\Delta L_1 \tag{18}$$

$$L_2=L_{20}+\Delta L_2$$

and when the upper body 2 (shown in FIGS. 1 and 2) is horizontal or can be approximated as horizontal, following equation is established between the values $L_{10}$ and $L_{20}$:

$$L_{10}=L_{20} \tag{20}$$

Accordingly, $$L_1^2\approx L_{10}^2+2L_{10}\Delta L_1 \tag{21}$$

$$L_2^2\approx L_{20}^2+2L_{20}\Delta L_2 \tag{22}$$

Further, when the leader 5 is vertical, the following equation is established.

$$Xs^2+Ys^2+L^2=L_{10}^2 \tag{23}$$

Accordingly, the following equations is obtained rearranging by substituting Eqs. (21), (22), and (23) into Eq. (17).

$$A=\frac{(Xs^2-Ys^2)L_{20}\Delta L_2-(Xs^2+Ys^2)L_{20}\Delta L_1}{-2C\sqrt{Xs^2+Ys^2\cdot XsYs}} \tag{24}$$

In the same manner, the detected angle $\beta$ by the inclinometer 10 can be given by the following equation.

$$B=\frac{(Xs^2+Ys^2)L_{20}\Delta L_2-(Xs^2-Ys^2)L_{20}\Delta L_1}{-2C\sqrt{Xs^2+Ys^2\cdot XsYs}} \tag{25}$$

From Eqs. (24) and (25) $\Delta L_1$ and $\Delta L_2$ are given by the following equation.

$$\begin{bmatrix}\Delta L_1\\ \Delta L_2\end{bmatrix}=\begin{bmatrix}\frac{L\sqrt{Xs^2+Ys^2}\,(Xs^2-Ys^2)}{2XsYsL_{20}} & \frac{-L(Xs^2+Ys^2)^{\frac{3}{2}}}{2XsYsL_{20}}\\ \frac{L(Xs^2+Ys^2)^{\frac{3}{2}}}{2XsYsL_{20}} & \frac{-L\sqrt{Xs^2+Ys^2}\,(Xs^2-Ys^2)}{2XsYsL_{20}}\end{bmatrix}\begin{bmatrix}A\\ B\end{bmatrix} \tag{26}$$

In Eq. (26), each element of the first matrix of the right side is constant, and $\Delta L_1$ and $\Delta L_2$ can be determined from the detected angles A and B of the leader inclinometers 9 and 10. Though Eq. (26) is established when the upper body 2 is horizontal, it was found as a result of tests performed by the use of the actual machine that even when the upper body 2 (vehicle body) is more or less inclined, the working lengths $\Delta L_1$ and $\Delta L_2$ of the backstay cylinders can be approximated by Eq. (26) without any effect on the control system of the invention.

Figure 7:
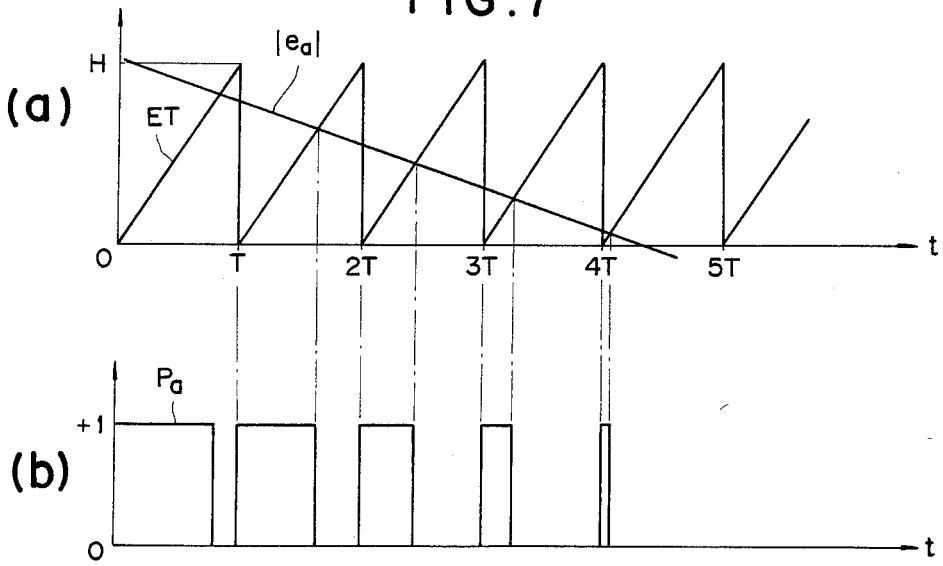
FIGS. 7 and 8 are timing charts for explaining a operation of the embodiment shown in FIG. 6.
Figure 6:
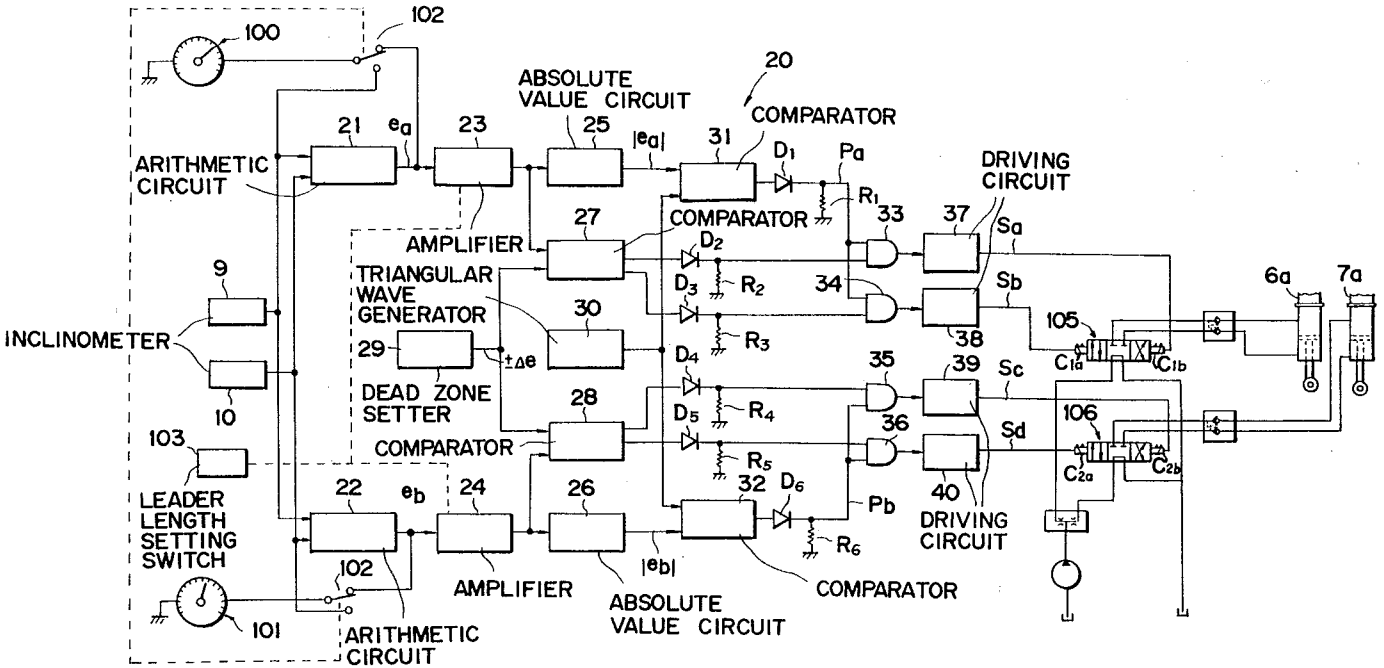
FIG. 6 is a block diagram showing an embodiment of the leader angle control device according to the present invention.
Figure 8:
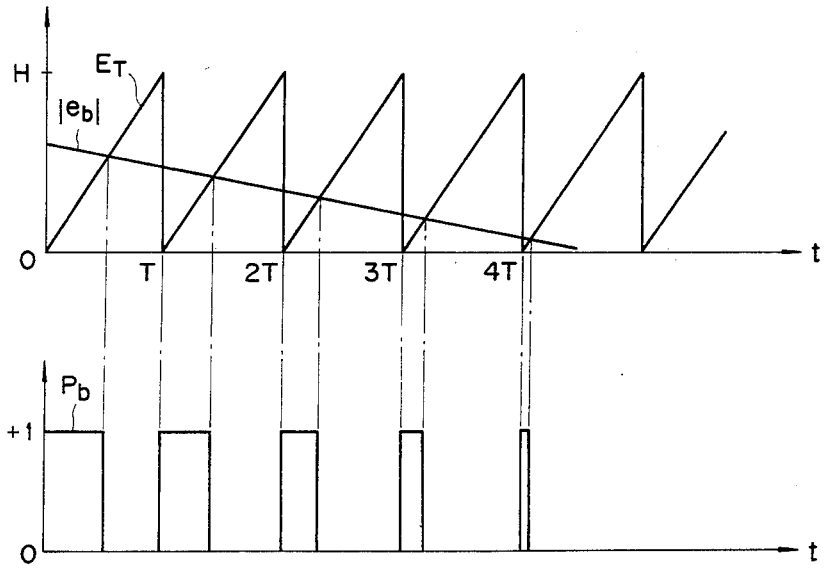

FIG. 6 is a block diagram of the leader angle control device of the present invention. The outputs of the inclinometers 9 and 10 are fed to arithmetic circuits 21 and 22 respectively. The arithmetic circuits 21 and 22 perform arithmetic operation according to Eq. (26) based on the output of the inclinometers 9 and 10. calculate values $\Delta L_1$ and $\Delta L_2$, and output signals ea and eb corresponding thereto. The signals ea and eb are amplified at amplifiers 23 and 24 respectively, and then fed to absolute value circuits 25 and 26, and comparators 27 and 28 respectively. The absolute value circuits 25 and 26 output absolute value signals |ea| and |eb| of the input signals ea and eb, and apply these signals to comparators 31 and 32, respectively. A dead zone setter 29 is for setting a dead zone corresponding to the tolerance of perpendicularity, and outputs a specified dead zone signal $\pm\Delta e$. On the other hand, a triangular wave generator 30 is for outputting a reference triangular wave signal ET (FIG. 7(*a*)) of the specified cycle T and output peak level H. The comparator 27, typically a window comparator compares signals eb and $\pm\Delta e$, when $eb<\Delta e$, outputs signal "1", and makes an AND circuit 35 enable, and when $eb<-\Delta e$, the comparator 27 makes an AND circuit 36 enable. The comparator 31 compares signals |ea| and ET, and outputs a pulse signal Pa of the pulse width corresponding to the difference between the working length of the cylinder when the leader is vertical and the working length of said cylinder when the leader is presently tilted (FIG. 7(*b*)) when $|ea|>ET$, applying it to the AND circuits 33 and 34. The comparator 32 compares signals |eb| and ET, and when $|eb|>ET$, outputs a pulse signal Pb (FIG. 8(*b*)) of the pulse width corresponding to the difference, applying the signal to the AND circuits 35 and 36. Driving circuits 38, 37, 39, and 40 are for delivering signals to control the extension and retraction of the back-stay cylinders 6*a* and 7*a*. When a pulse signal Pa is fed from the AND circuits 33 and 34, the driving circuits 37 and 38 output a retract/extend signal Sa or Sb of the corresponding back stay cylinder 6*a*, while the driving circuits 39 and 40 output an extend/retract signal Sc or Sd of the corresponding backstay cylinder 7*a* when a pulse signal Pb is fed from the AND circuit 35. These signals Sa, Sh, Sc and Sd are applied to each electromagnetic coil C1*a*, C1*b* and C2*a*, C2*b* of solenoid valves 105 and 106 in the hydraulic circuits of the backstay cylinders 6*a* and 7*a*. The oil flow is controlled by controlling the spools of the solenoid valves 105 and 106. Double check valves 107 and 108 open only when the pressure on the solenoid valve side is high, and close when the pressure is low, thus preventing the leader 5 from inclining due to oil leak.

A switch 102 mounted on the control device is a meter indication mode selector. When the switch 102 is positioned to the backstay cylinder mode, the valves $\Delta L1$, and $\Delta L2$ of the cylinder length calculated according to Eq. (26) are indicated on meters 100 and 101 respectively. When the switch 102 is positioned to the inclination angle mode, the inclination angles A and B of the leader are directly indicated. A leader length setting switch 103 is for setting the gains of the amplifiers 23 and 24. A switch 104 is a MAN/AUTO changeover switch.

Now, let's assume that the leader 5 is inclined, and that the center O' is at the point P as shown in FIG. 4. From the arithmetic circuits 21 and 22, signals ea and eb corresponding to the valves $\Delta L1$ and $\Delta L2$ are output respectively. When the relationship between the signal ea and the dead zone setting signal $\pm\Delta e$ and that between the signal eb and the signal $\pm\Delta e$ are $ea>\Delta e$ and $eb>\Delta e$, the AND circuits 33 and 36 become enable. Accordingly pulse signals Pa (FIG. 7(*b*)) and Pb (FIG. 8(*b*)) outputted from the comparators 31 and 32 are fed to the driving circuits 37 and 40 through the AND circuits 33 and 36 respectively. The driving circuits 37 and 40 output control signals Sa and Sd corresponding to the input signals Pa and Pb. The backstay cylinders 6*a* and 7*a* are retraction-controlled by the quantity of oil corresponding to the pulse widths of the control signals Sa and Sd, and the shift control of the center O' of the leader 5 (FIG. 4) is performed so that said center O' shifts from the position of point P to the vertical line of the point O. When the inclination angle of the leader 5 comes within the dead zone set value $\pm\Delta e$, the AND circuits 33 and 36 become disable, and the control signals Sa and Sb cease to be output. Accordingly, the backstay cylinders 6*a* and 7*a* stop, and the leader 5 is firmly held in that position. Thus the leader 5 is set vertically by driving the two backstay cylinders 6a and 7a concurrently and directly displacing the center O' of the leader 5 from the position of point P to the vertical line of the point O, thereby setting the leader 5 vertical.

Although the preferred embodiment the inclinometers 9 and 10 are disposed so as to intersect orthogonally to the lines 11 and 12 respectively, it is also feasible that those are disposed so as to be in parallel with the X axis and Y axis of FIG. 3 and the values when disposed so as to intersect orthogonally to the lines l1 and l2 are obtained from individual outputs.

In this case, the following relationship exists:

$$\begin{bmatrix} A \\ B \end{bmatrix} = \begin{bmatrix} -\sin\phi & -\cos\phi \\ \sin\phi & -\cos\phi \end{bmatrix} \begin{bmatrix} \theta x \\ \theta y \end{bmatrix} \tag{27}$$

where $\theta X$ is the output of inclinometer detecting the inclination in parallel with the X axis, $\theta Y$ is the output of inclinometer detecting the inclination in parallel with the Y axis, and $\rho$ is an angle formed between the lines l1 and l2 in FIG. 4. By substituting the above equation (27) into Eq. (26), the relationship between the inclination angle and cylinder length in the case of the inclinometers disposed so as to be in parallel with the axes X Y can be obtained as follows:

$$\begin{bmatrix} \Delta L_1 \\ \Delta L_2 \end{bmatrix} = \begin{bmatrix} -\dfrac{LXs\sqrt{Xs^2+Ys^2}}{YsL_{20}} \times \sin\phi & \dfrac{LYs\sqrt{Xs^2+Ys^2}}{XsL_{20}} \times \cos\phi \\ -\dfrac{LSx\sqrt{Xs^2+Ys^2}}{YsL_{20}} \times \sin\phi & \dfrac{LYs\sqrt{Xs^2+Ys^2}}{XsL_{20}} \times \cos\phi \end{bmatrix} \begin{bmatrix} \theta X \\ \theta Y \end{bmatrix} \tag{28}$$

Figure 9:
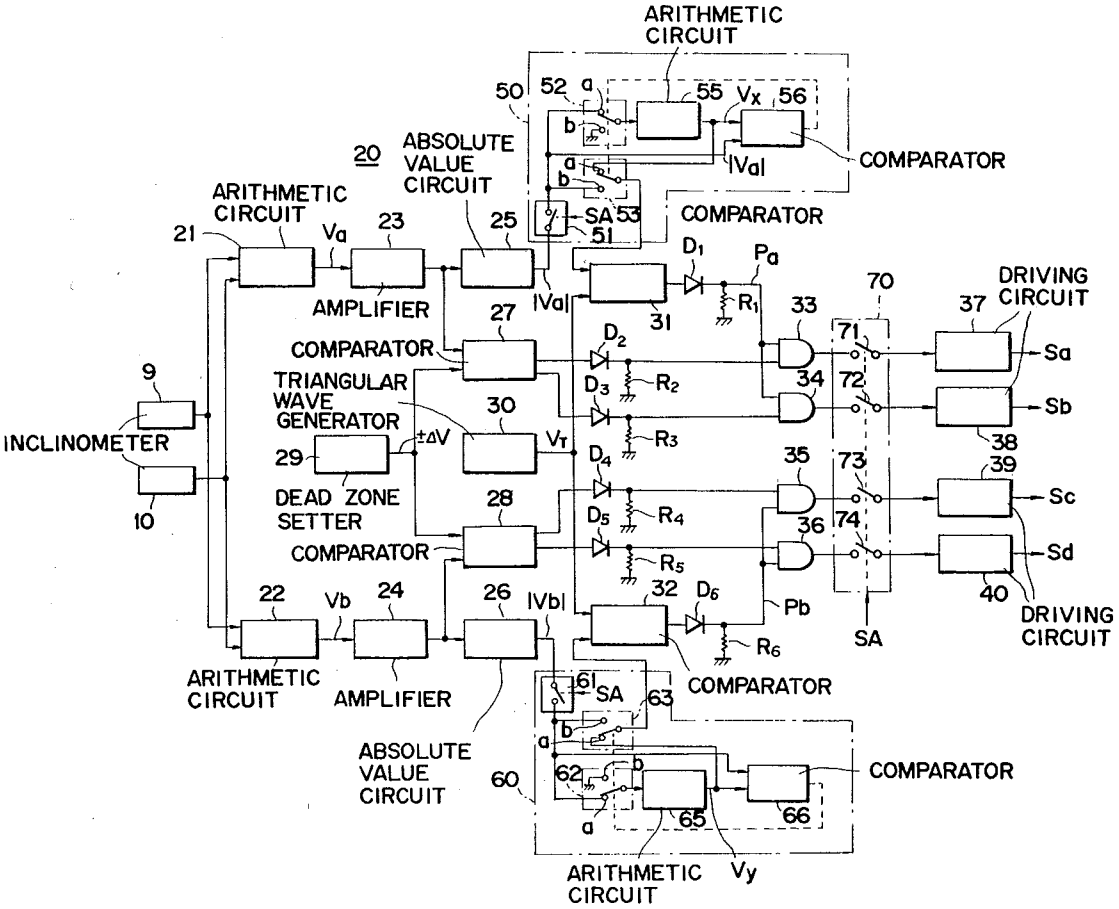
FIG. 9 is a block diagram showing an another embodiment of the leader angle control device according to the present invention.

FIG. 9 shows another embodiment of the leader angle control device of the present invention, which is designed so that when the leader is operated manually to a certain extent and then shifted to the automatic range, acceleration to be applied to the leader at the automatic control start-up is kept small by reducing the output of said comparators 31 and 32 temporarily and then gradually increasing the acceleration.

For the above purpose, start control circuits 50 and 60 are provided between the absolute value circuit 25 and the comparator 31 and between the absolute value circuit 26 and the comparator 60 respectively.

Figure 10:
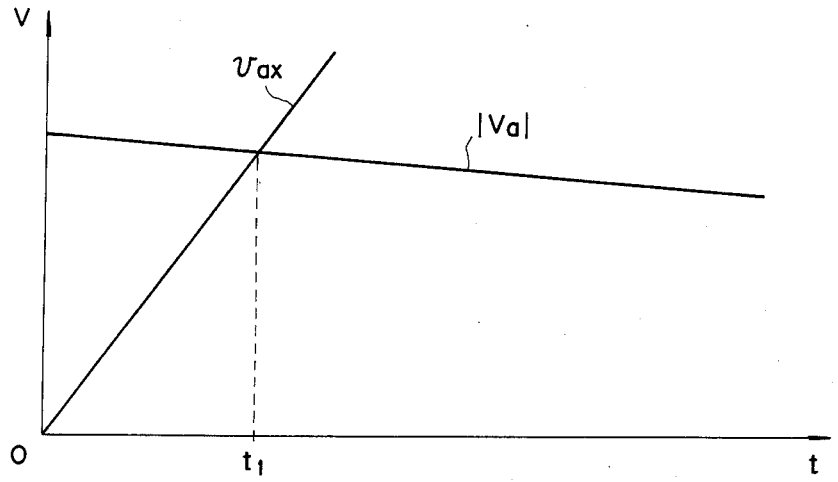
FIGS. 10, 11(*a* and *b*) and 12(*a* and *b*) are timing charts for explaining an operation of the embodiment shown in FIG. 9.

The output signal |Va| of absolute value circuit 25 is fed to an arithmetic circuit 55 through a switch 51 and the contact a of an analog switch 52 in the start control circuit 50. The switches 51 and 52 are closed during the automatic control mode of operation. The arithmetic circuit 55 is comprised of a primary or a secondary delay element, typically an integrating circuit, integrates the input signal |Va|, and outputs the signal thus integrated as a signal Vx (FIG. 10), This signal Vx can be expressed by the following equation.

$$Vx = K_1 \int_0^t |Va|\, dt \tag{29}$$

where $K_1$ is an integration constant. This signal Vx is fed to the one input of a comparator 56 and the contact a of an analog switch 53. The signal |Va| is fed to the other input of the comparator 56 and the contact b of the analog switch 53. The comparator 56 compares the input signal Vx with the signal |Va|, outputs a signal when Vx<|Va| to transfer the analog switches 52 and 53 to the contact a, and when Vx>|Va|, outputs a signal to transfer the switches 52 and 53 to the contact b. Accordingly, when Vx<|Va|, Vx is fed from the analog switch 53 to the comparator 31, and when Vx>|Va|, |Va| is applied from the analog switch 53 to the comparator 31.

The start control circuit 60 is configured similar to the start control circuit 50. An arithmetic circuit 65 integrates the signal |Vb| fed through a switch 61 and and analog switch 62, and outputs the signal thus integrated as a signal Vy. The signal Vy can be expressed as follows:

$$Vy = K_2 \int_0^t |Vb|\, dt \tag{30}$$

where $K_2$ is an integration constant.

A comparator 66 compares the input signal Vy with |Vb|, transfers the analog switches 62 and 63 to the contact a when Vy<|Vb|, and transfers to the contact b when Vy>|Vb|. The signal Vy or |Vb| outputted from the analog switch 63 is fed to a comparator 32. The Switches 51 and 61 becomes ON when an automatic start command signal SA is fed in the automatic control mode. The automatic start command signal SA is output when the operator turns on automatic start switch 104 (FIG. 6).

Figure 11:
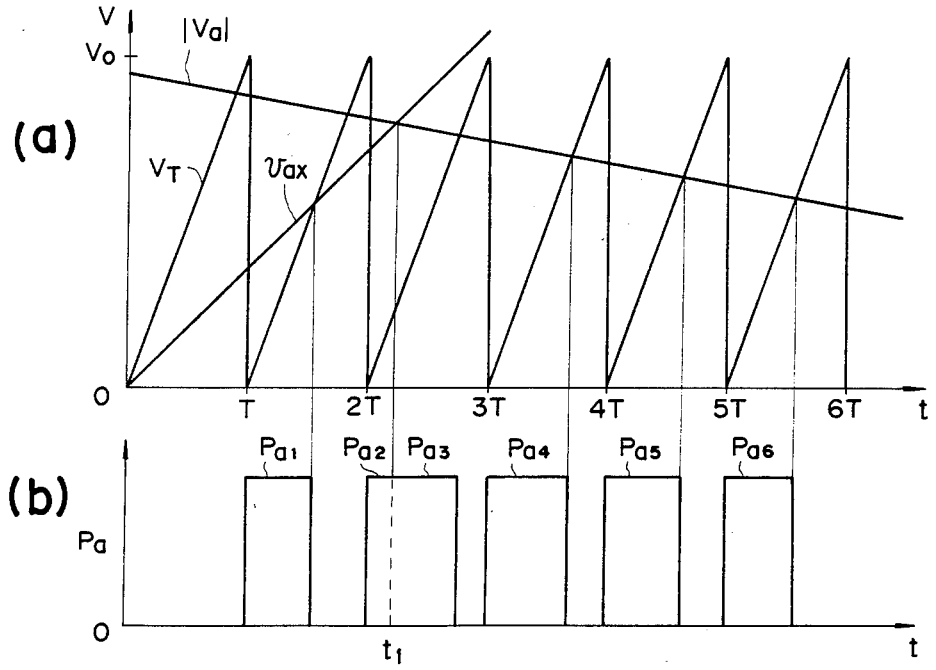
Figure 12:
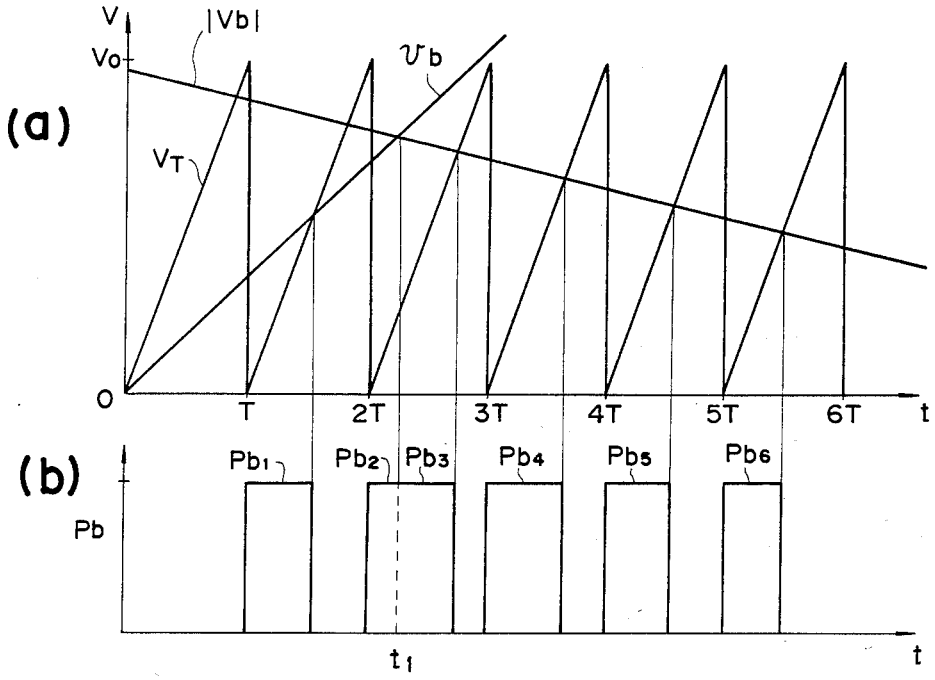

A comparator 31 compares the signal Vx or |Va| with VT, initially outputs signals of the pulse width corresponding to Vx, and when Vx becomes larger than |Va|, outputs pulse signals Pa1 to Pa6 (FIG. 11*b*) of the pulse width corresponding to VA, applying those signals to AND circuits 33 and 34. A comparator 32 compares the signal Vy or |Vb| with VT, and outputs similar pulse signals Pb1 to Pb6 (FIG. 12*b*), applying those signals to AND circuits 35 and 36. The output signals of the AND circuits 33 to 36 are fed to driving circuits 37 to 40 through swtiches 71 to 74 of an MAN-AUTO switching circuit 70 respectively. Each switch 71–74 of the switching circuit 70 becomes ON when the automatic start command signal SA is applied to the switches 51 and 61.

The hydraulic circuits of the back-stay cylinders 6a and 7a are designed so that the manual operation has priority over the automatic control, and the leader 5 can be controlled manually even in the automatic control mode of operation.

As described above, through the control using the signals Vx and Vy in lieu of signals |Va| and |Vb| at the automatic control start-up, acceleration to be applied to the leader 5 can be reduced to a small value, enabling to maintain the stability of the vehicle.

Figure 13:
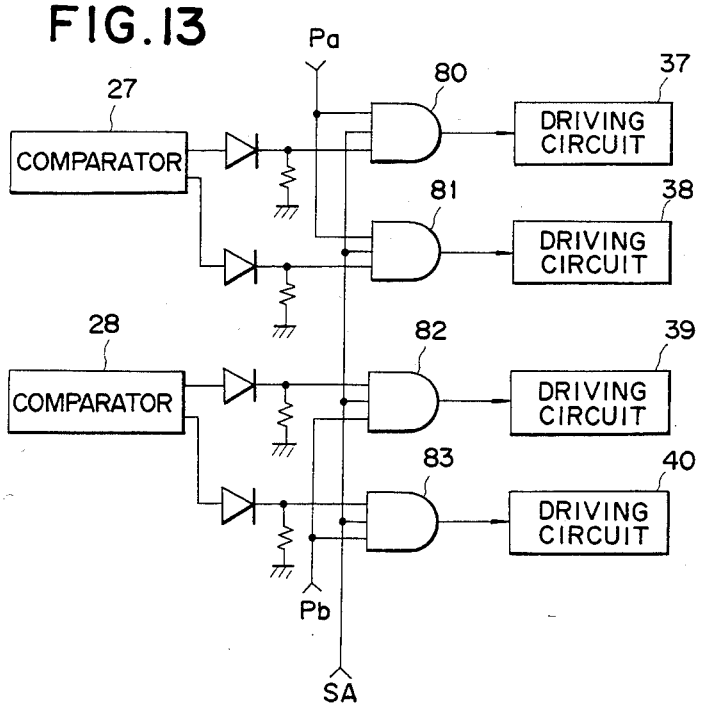
FIG. 13 is a circuit diagram showing a modification of the MAN-OUTO switching circuit shown in FIG. 9.

FIG. 13 shows a modification of the MAN-AUTO switching circuit 70 shown in FIG. 9. AND circuits 80 to 83 are used in lieu of the AND circuits 33 to 36, and are designed to become ready condition when an automatic start command signal SA is fed. The circuit configuration can be simplified by such arrangement.

Though in the embodiment shown in FIG. 9 arrangement has been made to provide the switches 51 and 61 in the start control circuits 50 and 60 respectively and to cause the switches 51 and 61 to become ON at the automatic start-up, other alterations and modifications may be made, for example, it is feasible to provide a switch circuit in the input side of arithmetic circuits 21, 22, or to cause the power switch of the control device to be turned on.

Further, though in each embodiment, description has been made regarding the proportional control system, the leader angle control device of the present invention can be applied to other control systems. For example, in the case of the ON-OFF control system, all that is required is to make the system a three level control system providing an additional level between ON and OFF.

What is claimed is:

1. A leader angle control device for foundation civil engineering works machines having a leader supported by two backstays each provided with a backstay cylinder together with a bracket comprising:

inclination detecting means for detecting the leader inclination angle and for producing output signals;

arithmetic means for receiving said output signals from said inclination detection means and for calculating the difference between the working lengths of said cylinder when the leader is vertical and the current working length of said cylinders;

control means responsive to said arithmetic means for controlling the quantity of the driving oil flow of the backstay cylinder so as to make the difference zero;

a start control circuit for forming a deviation signal which increases up to the value corresponding to said differences by making a signal representing said difference pass through a delay element and for delivering said deviation signal to said control means for a predetermined time.

2. A leader angle control device of claim 1 further comprising a MAN-AUTO changeover switch for switching between manual operation mode in which the leader inclination is controlled manually and automatic operation mode in which the leader inclination is controlled automatically.

3. The leader angle control device of claim 2 wherein said start control circuit comprises an arithmetic circuit for integrating said deviation signal, a comparator for comparing the output of said arithmetic circuit with said deviation signal, and a switch which is switched according to the ouput of said comparator for delivering the output of said arithmetic circuit for a predetermined time.

4. A leader angle control device for foundation civil engineering works machines having a leader pivotal about a fulcrum and supported by two backstays each provided with a respective backstay cylinder for changing the lengths of the backstays, said leader being controlled by adjusting the lengths of said two backstays, comprising:

inclination detecting means for detecting leader inclination angles with respect to two directions to produce two inclination signals;

arithmetic means for calculating the lengths $\Delta L1$ and $\Delta L2$ to which said respective backstay cylinders must be adjusted so that said leader becomes vertical based on the work lengths of said cylinders when said leader is vertical and said two inclination signals from said inclination detecting means;

control means for controlling the quantity of driving oil flow of said backstay cylinders so as to make said quantity in proportion to said lengths $\Delta L1$, $\Delta L2$, said quantity of driving oil flow of each said backstay cylinder being controlled independently from each other.

5. A leader angle control device of claim 4 further comprising a display device for displaying said lengths of said two backstays L1 and L2.

6. A leader angle control device of claim 4 further comprising a MAN-AUTO changeover switch for switching between manual operation mode in which the leader inclination is controlled manually and automatic operation mode in which the leader inclination is controlled automatically, and a start control circuit for forming a deviation signal which increases up to the value corresponding to said differences by making a signal representing said difference pass through a delay element and for delivering said deviation signal to said control means for a predetermined time.

7. The leader angle control device of claim 6 wherein said start control circuit comprises an arithmetic circuit for integrating said deviation signal, a comparator for comparing the output of said arithmetic circuit with said deviation signal, and a switch which is switched according to the output of said comparator for delivering the output of said arithmetic circuit for a predetermined time.

8. A leader angle control device for foundation civil engineering works machines having a leader supported by one or more backstays each provided with an inclination producing device comprising:

means for producing an inclination intensity signal;

means for actuating an inclination producing device for controlled portions of subsequent like time periods, the portion of each time period during which said inclination producing device is actuated being established by said inclination intensity signal value.

9. The leader angle control device of claim 8 further comprising:

means for establishing a signal tolerance;

means for repetitively generating a reference signal; and means for comparing said inclination intensity when greater than said signal tolerance, with said reference signal to produce a differential time signal which is supplied to said means for actuating an inclination producing device.

10. A leader angle control device for foundation civil engineering work machines having a leader supported by one or more moveable backstays, each provided with an independent backstay mover comprising:

means for producing a gradually decreasing inclination indicating signal indicative of the angle of said leader tilted with respect to the desired leader angle;

means, responsive to said gradually decreasing inclination indicating signal, for developing an inclination control signal having a successive time duration proportional to said gradually decreasing inclination indicating signal.

11. The leader angle control device of claim 10 further comprising:

means for positioning said one or more backstays responsively to said inclination control signal, so that said leader is positioned with steps of decreasing size as the desired angle is approached.

12. A method of leader angle control comprising:

measuring the inclination of the leader;

moving the leader toward a desired angle in steps;

and controlling the step size in inverse response to the measured inclination, so that the size decreases as the desired angle is approached.

* * * * *